US011175044B2

(12) United States Patent
Jette et al.

(10) Patent No.: US 11,175,044 B2
(45) Date of Patent: Nov. 16, 2021

(54) FUEL SWIRLER FOR PRESSURE FUEL NOZZLES

(71) Applicant: PRATT & WHITNEY CANADA CORP., Longueuil (CA)

(72) Inventors: Sylvain Jette, St-Lambert (CA); Oleg Morenko, Oakville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 161 days.

(21) Appl. No.: 16/406,388

(22) Filed: May 8, 2019

(65) Prior Publication Data

US 2020/0355370 A1 Nov. 12, 2020

(51) Int. Cl.

| | |
|---|---|
| ***F23R 3/14*** | (2006.01) |
| ***F02M 61/16*** | (2006.01) |
| ***F23D 11/10*** | (2006.01) |

(52) U.S. Cl.

CPC ..... *F23R 3/14* (2013.01); *F02M 61/162* (2013.01); *F23D 11/107* (2013.01)

(58) Field of Classification Search

CPC ..... F23R 3/14; F02M 61/162; F23D 11/383; F23D 11/107

See application file for complete search history.

(56) References Cited

U.S. PATENT DOCUMENTS

| | | | | |
|---|---|---|---|---|
| 7,360,363 | B2 | 4/2008 | Mandai et al. | |
| 2012/0047903 | A1* | 3/2012 | Williams | F02C 7/22 60/746 |

FOREIGN PATENT DOCUMENTS

| | | | |
|---|---|---|---|
| EP | 633947 | A | 12/1949 |
| EP | 2592351 | A1 | 5/2013 |
| EP | 2965821 | A1 | 1/2016 |
| WO | WO97/21958 | A1 | 6/1997 |
| WO | WO00/19146 | A2 | 4/2000 |
| WO | WO2005/061964 | A1 | 7/2005 |

OTHER PUBLICATIONS

European Search Report issued in counterpart appliction No. EP20173987 dated Oct. 9, 2020.

* cited by examiner

*Primary Examiner* — Katheryn A Malatek
(74) *Attorney, Agent, or Firm* — Norton Rose Fulbrght Canada LLP

(57) ABSTRACT

A fuel swirler, for a gas turbine engine, has a primary cone housing defining an interior chamber. The interior chamber has an inlet in communication with a source of pressurized fuel. The interior chamber has a transition portion and a socket portion with an axisymmetric interior surface. A swirler core is disposed within the interior chamber. The swirler core has a downstream end and an upstream shank portion having an exterior surface mating the axisymmetric interior surface of the socket portion. The shank portion has a plurality of axially extending grooves. The grooves are disposed axisymmetrically about the exterior surface of the shank portion.

12 Claims, 7 Drawing Sheets

PRIORT ART

FUEL SWIRLER FOR PRESSURE FUEL NOZZLES

TECHNICAL FIELD

The disclosure relates to gas turbine engines and, more particularly, to a fuel swirler for a fuel nozzle.

BACKGROUND

Fuel nozzles are used for injecting fuel and air mixtures into the combustors of gas turbine engines. Compressed fuel is typically fed under pressure into a central fuel swirler and a surrounding array of pressurized air flow channels is provided to form an atomized air/fuel mixture.

The fuel swirler may be assembled from a swirler housing with an interior chamber and a swirler core that is press fit into the interior chamber of the swirler housing. The combined configuration of control surfaces between the swirler housing and swirler core define fuel flow channels and shaped surfaces that control the direction, pressure and kinetic energy of the pressurized fuel flow to achieve a desired set of parameters for the fuel spray exiting the fuel outlet orifice.

SUMMARY

In one aspect, there is provided a fuel swirler for a gas turbine engine fuel nozzle, the fuel swirler comprising: a swirler housing defining an interior chamber having a fuel outlet, the interior chamber having a transition portion axially disposed downstream from a socket portion relative to a fuel flow direction through the fuel swirler, the socket portion having an axisymmetric interior surface; and a swirler core disposed within the interior chamber, the swirler core having a downstream end and an upstream shank portion having an exterior surface for mating with the axisymmetric interior surface of the socket portion; the upstream shank portion having a plurality of generally axially extending grooves, the plurality of generally axially extending grooves being disposed axisymmetrically around an axis of the upstream shank portion.

In accordance with another aspect, the disclosure describes a fuel swirler, for a gas turbine engine, having a swirler housing having a fuel outlet from an interior chamber, the interior chamber having an inlet in communication with a source of pressurized fuel, the interior chamber comprising a transition portion axially disposed upstream from a socket portion with an axisymmetric interior surface; a swirler core disposed within the interior chamber, the swirler core having a downstream end and an upstream shank portion having an exterior surface matching the axisymmetric interior surface of the socket portion; and wherein the downstream end includes a plurality of fuel channels, and the shank portion has a plurality of axially extending grooves, the grooves being disposed axisymmetrically about the exterior surface of the shank portion. Embodiments can include combinations of the above features.

In accordance with a further aspect, there is provided a method of assembling a fuel swirler comprising a swirler housing with an interior chamber and a socket portion with an axisymmetric interior surface; and a swirler core having a downstream end and a shank portion, the method comprising: providing a plurality of axially extending grooves disposed axisymmetrically about the exterior surface of the shank portion, and inserting the swirler core into the swirler housing.

Further details of these and other aspects of the subject matter of this application will be apparent from the detailed description included below and the drawings.

DETAILED DESCRIPTION

Figure 1:
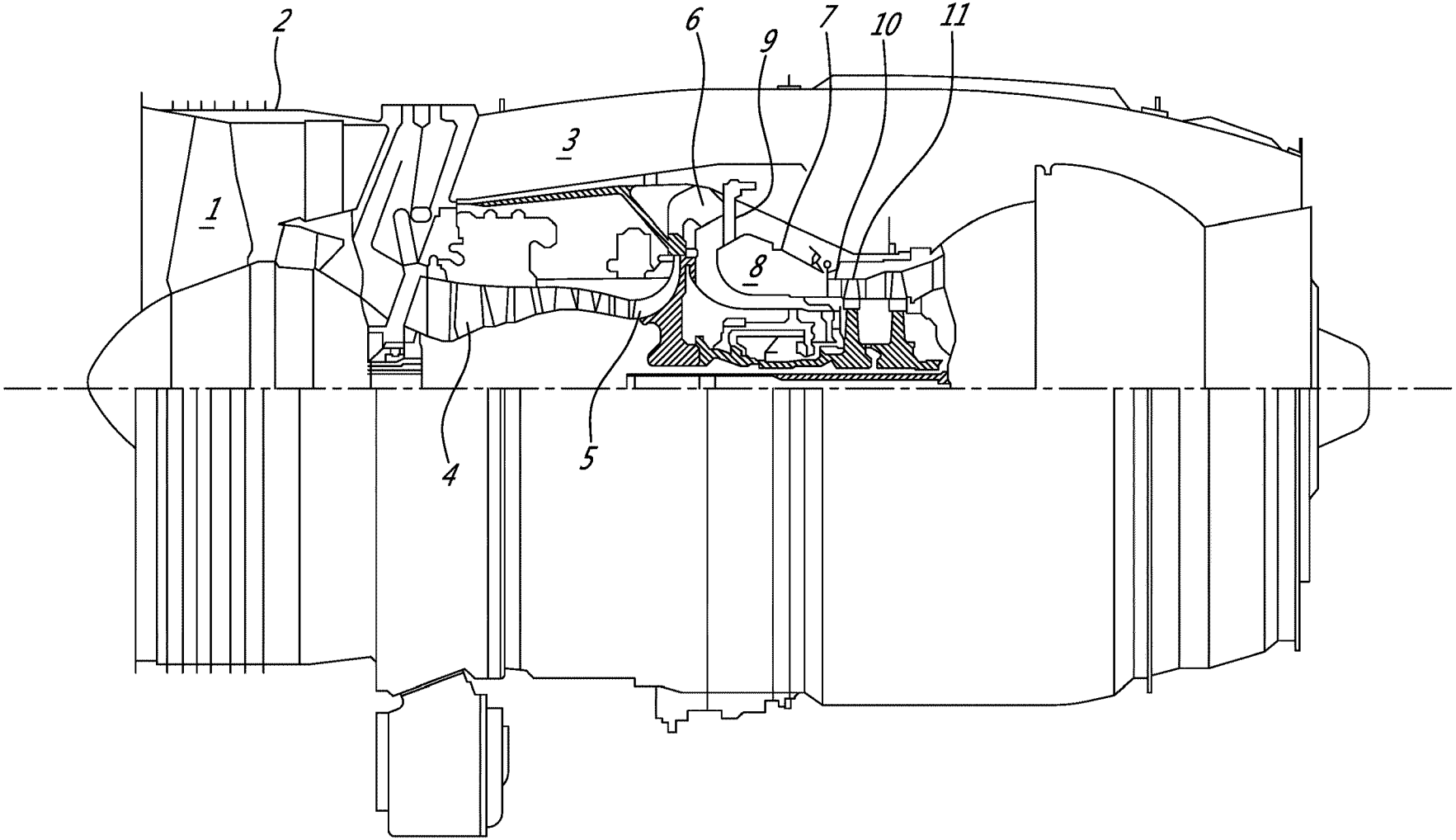
FIG. 1 shows an axial cross-section view of an example turbo-fan gas turbine engine.

FIG. 1 shows an axial cross-section through an example turbo-fan gas turbine engine. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes 9 and fuel is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vane 10 and turbines 11 before exiting the tail of the engine as exhaust.

The present description is directed to fuel nozzles at the terminus of the fuel tubes 9 which direct an atomized fuel-air mixture into the combustor 8. A fuel nozzle includes a concentric array of compressed air orifices to create a swirling air flow surrounding a central fuel injecting swirler. The resultant shear forces between air and fuel cause the fuel and air mix to together and form an atomized fuel-air mixture for combustion.

Figure 2:
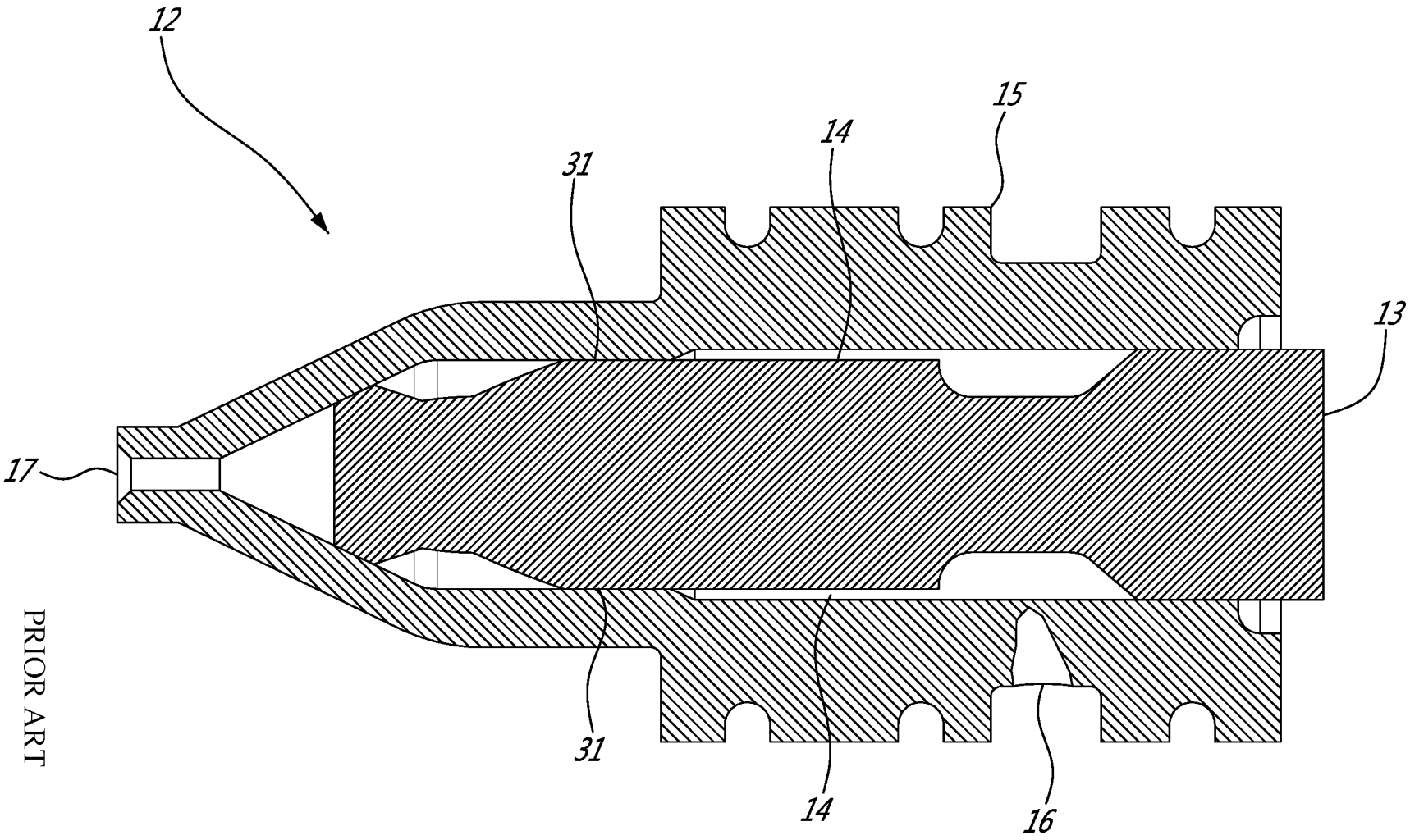
FIG. 2 PRIOR ART
FIG. 2 is an axial detail cross-section view through a conventional fuel swirler showing the swirler core press fit into the interior chamber of the swirler housing to define fuel directing channels and surfaces between the core and housing, the plane of FIG. 2 being indicated with section lines 2-2 in FIG. 4.

FIG. 2 shows an axial detail cross-section view through a fuel swirler 12. The outer components of the fuel nozzle that serve to direct compressed air are not shown since the focus of the present description is on the central fuel swirler 12 of the fuel nozzle alone. FIG. 2 shows a swirler core 13 that is press fit with axial force sliding axially into an interior chamber 14 of a swirler housing 15. The interior surfaces of the interior chamber 14 and the exterior surfaces of the swirler core 13 define fuel directing channels and other control surfaces that convey fuel between the swirler core 13 and housing 15, as indicated with arrows in FIG. 3, from a fuel inlet 16 to a fuel outlet orifice 17.

Figure 3:
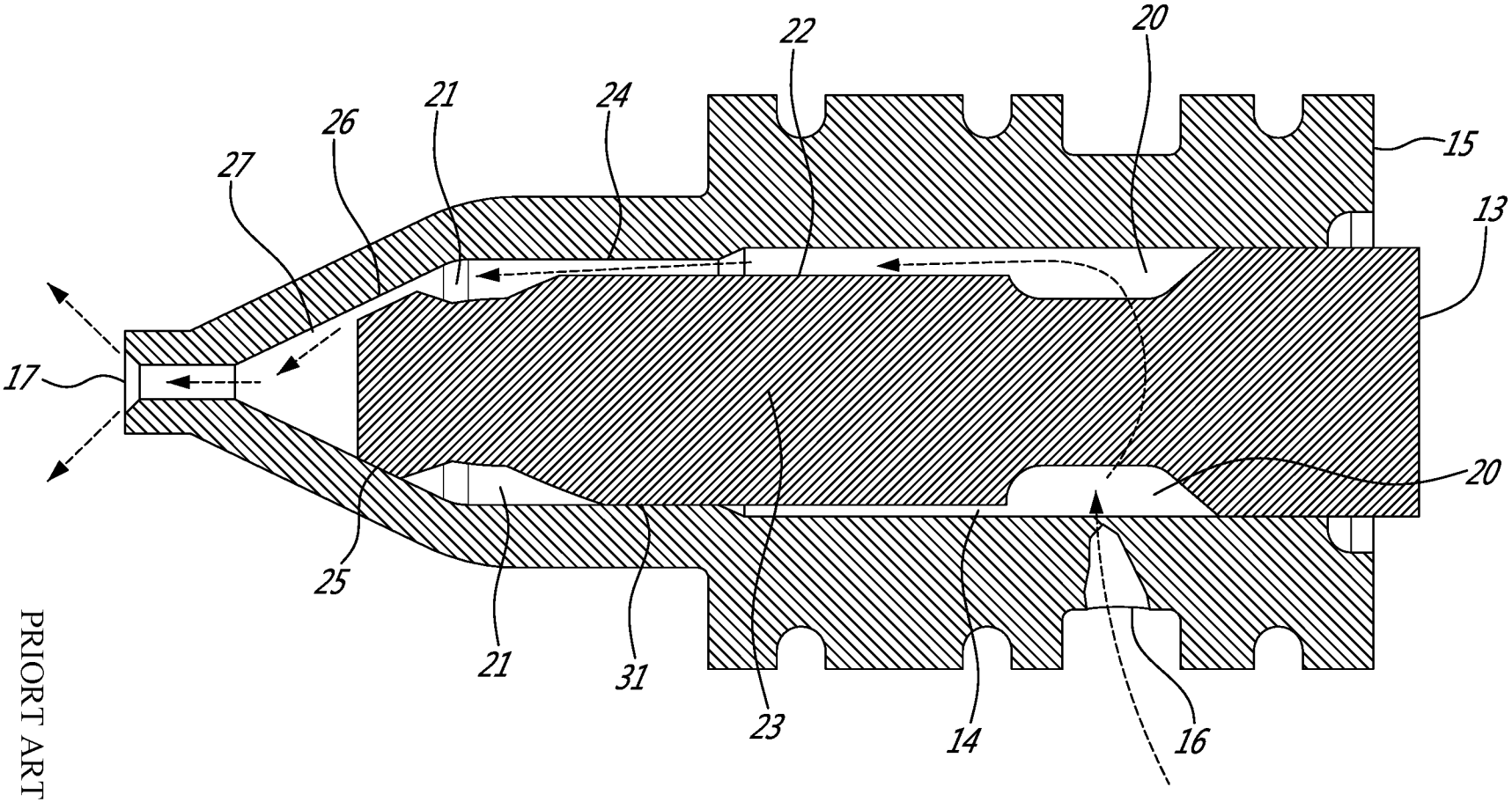
FIG. 3 is a like axial cross-section of the conventional swirler core of FIG. 2, the plane of FIG. 3 being indicated with section lines 3-3 in FIG. 4.
Figure 4:
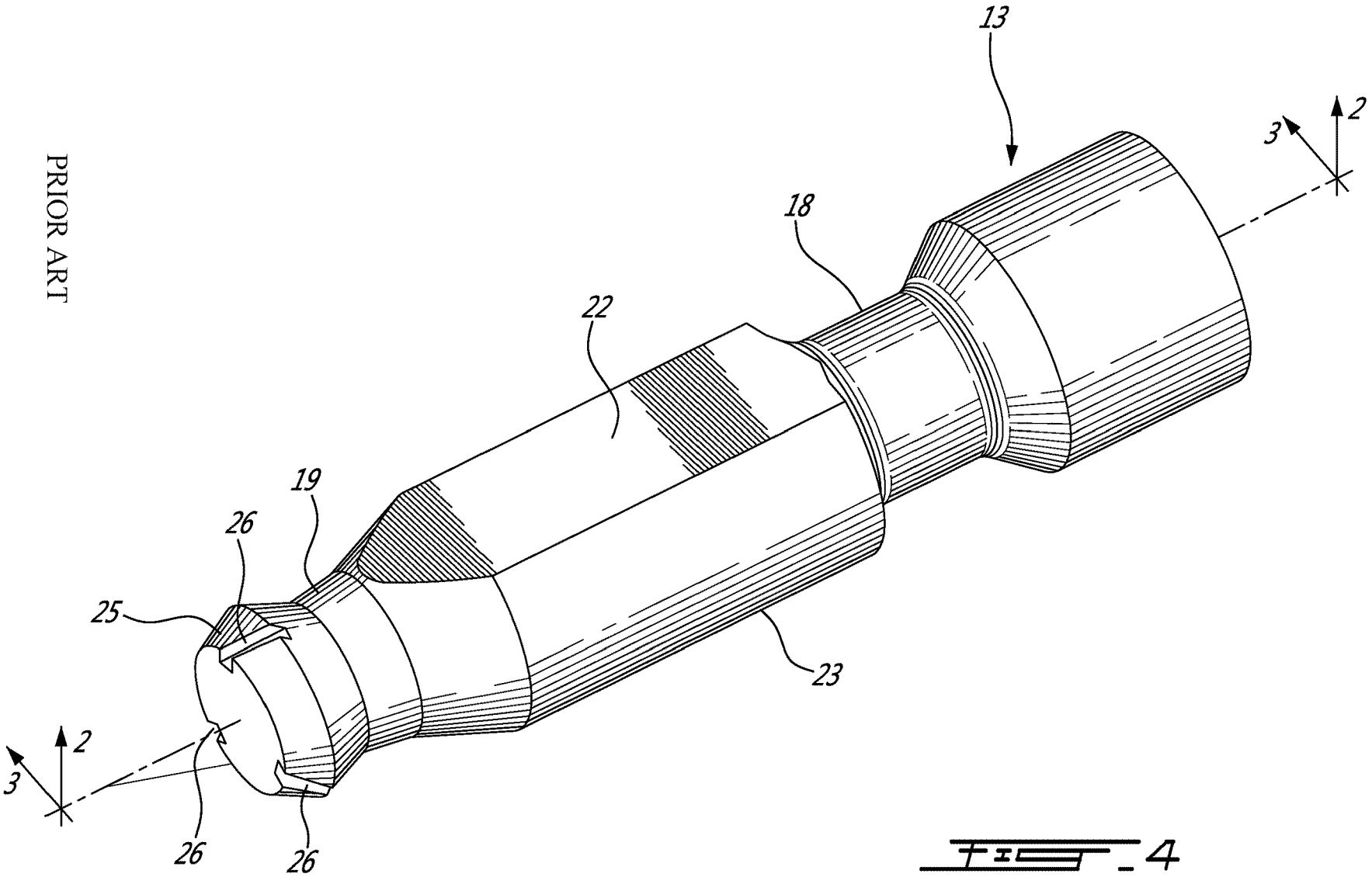
FIG. 4 PRIOR ART
FIG. 4 is an isometric view of the conventional swirler core of FIG. 2, the plane of FIGS. 2 and 3 being indicated with section lines 2-2 and 3-3 respectively.

The flow of fuel is best shown in FIG. 3 together with the isometric view of the swirler core 13 shown in FIG. 4. Fuel under pressure enters via the fuel inlet 16 into the interior chamber 14 of the swirler housing 15. The exterior surfaces of the swirler core 13 direct the fuel flow towards the outlet orifice 17 as follows.

As seen in FIG. 4, the swirler core 13 has a generally cylindrical exterior surface with areas of reduced diameter to form an inlet waist zone 18 and a tip waist zone 19. Wth reference to FIG. 3, the inlet waist zone 18 creates an annular inlet gallery 20 and the tip waist zone 19 creates an annular tip gallery 21. The galleries 20, 21 serve to distribute fuel circumferentially about the swirler core 13.

With reference to FIG. 3, a flat portion 22 on the shank 23 of the swirler core 13 extends axially between the inlet waist zone 18 and the tip waist zone 19 to create an elongated axial fuel passage 24 (FIG. 4) with a secant cross-section that conveys fuel from the annular inlet gallery 20 to the annular tip gallery 21. With reference to FIG. 3, the swirler core 13 has a conical downstream end 25 with three spaced apart recessed fuel channels 26. As seen in FIG. 4, the conical downstream end 25 abuts a conical transition portion 27 of the interior chamber 14. Fuel flows through the fuel channels 26 from the tip waist zone 19 to the conical transition portion 25 and exits through the outlet orifice 17.

With reference to FIG. 3, to press fit the swirler core 13 into the interior chamber 14 an axial force is applied until the conical downstream end 25 of the swirler core 13 engages against the conical transition portion 27. The fuel passage 24 constitutes a large gap between the flat portion 22 of the swirler core 13 and the interior chamber 14. The axial force creates unbalanced compressive stress that can buckle or laterally distort the swirler core 13 due to the asymmetric cross-section in the area of the flat portion 22. Since the swirler core 13 is not confined by the interior chamber 14 in the area of the flat portion 22, the shank 23 can bend or buckle under axial force that tends to narrow the cross sectional area of the fuel passage 24. Plastic deformation can reduce the fuel passage 24 or change its geometry. Unintended distortion can restrict fuel flow and lead to differences in the flow characteristics obtained from fuel swirlers 12 that are assembled from the swirler cores 13 and swirler housings 15.

Figure 5:
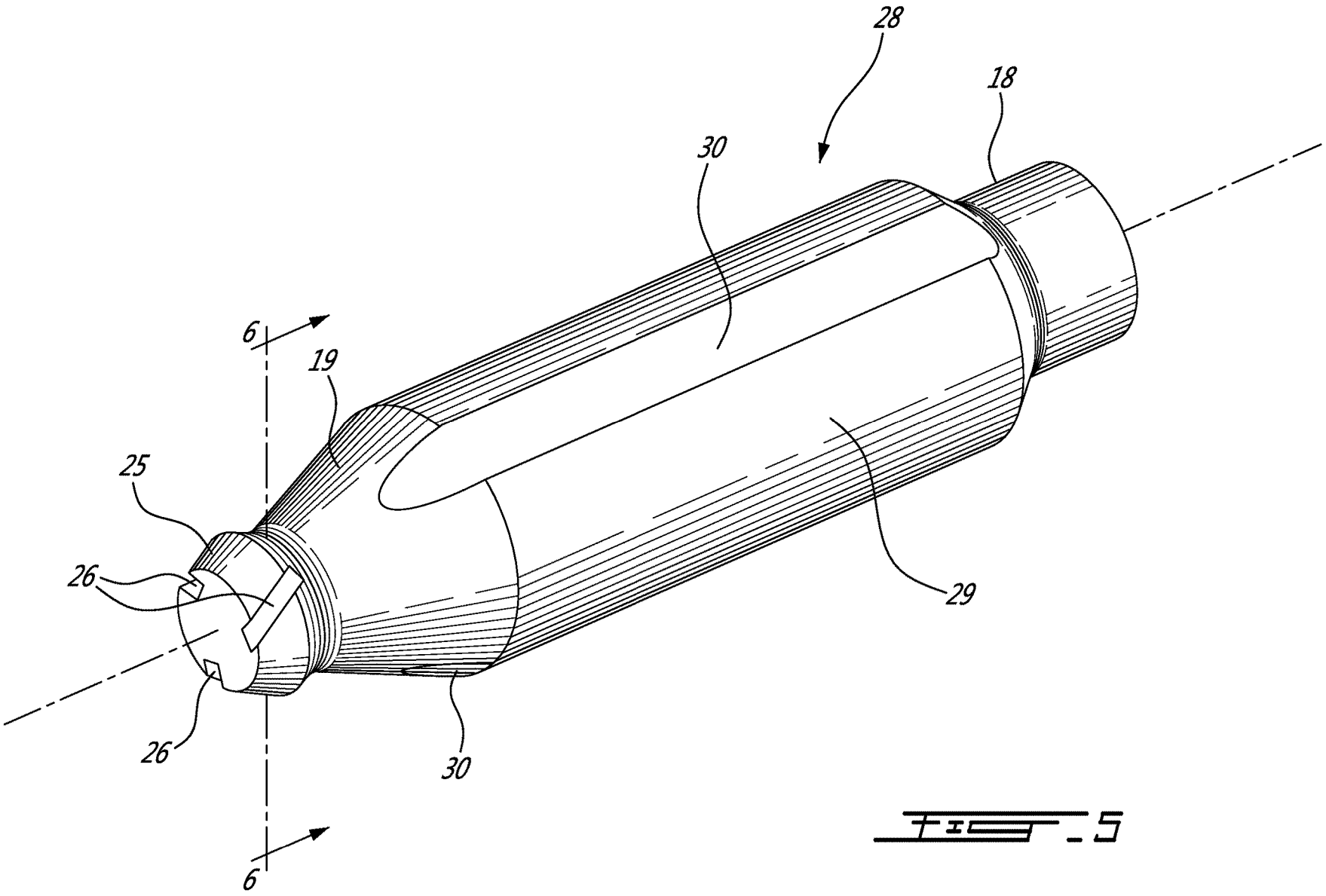
FIG. 5 is an isometric view of a swirler core in accordance with the present description showing an axially extending groove in an exterior surface of the shank of the swirler core.
Figure 6:
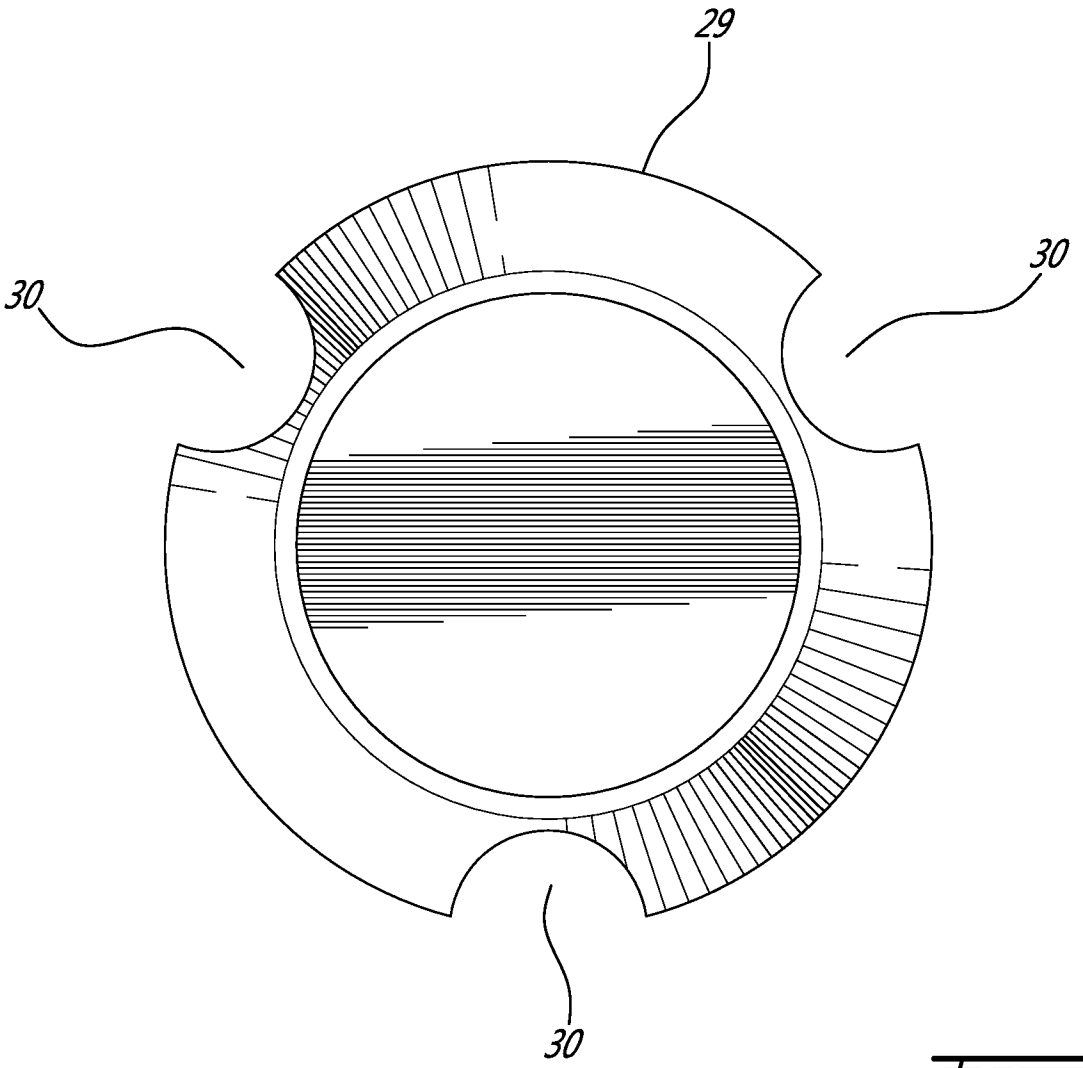
FIG. 6 is a partial radial cross-sectional view along section line 6-6 of FIG. 5.

FIGS. 5 and 6 show a swirler core 28 in accordance with at least one embodiment where the shank 29 has three axially extending grooves 30 disposed axisymmetrically about the exterior surface of the shank 29 (i.e. the grooves are disposed symmetrically around the axis of the shank 29). Any number of axially extending grooves 30, in excess of one groove 30, can be arranged in a circumferentially spaced apart array that results in an axisymmetric cross-section. FIG. 6 shows three grooves 30 but two or more grooves 30 can be axisymmetrically distributed in other manners as well. Further the grooves 30 need not have identical cross-sectional areas provided that the resulting arrangement remains axisymmetrical.

An axisymmetrical shank 29 under axial force will have balanced compressive axial stresses radially across the uniform cross-sectional area of the shank 29. There is no force imbalance to create non-elastic bending, buckling or lateral distortion since the axisymmetrical cross-section provides an axisymmetrical distribution of stress.

Accordingly referring to FIGS. 2-4 the imbalanced stresses and resultant lateral distortion of the conventional asymmetric shank 23, caused by the flat portion 22 on one side of the shank 23, has been corrected by providing an axisymmetric shank 29 with a plurality of axially extending grooves 30 that produce a balanced stress distribution that is symmetrical about the central axis. The grooves 30 provide for fuel flow between the annular galleries 20, 21 that is not restricted or otherwise distorted when axial press fitting forces are applied to the swirler core 28.

The use of the swirler core 28 does not require any changes to the swirler housing 15 or interior chamber 14 of FIGS. 2-4. As such the swirler core 28 can easily replace the conventional swirler core 13 during manufacture or fuel nozzle maintenance.

To recap the description, the primary cone swirler housing 15 has a fuel outlet orifice 17 from the interior chamber 14. The interior chamber 14 has a fuel inlet 16 in communication with a source of pressurized fuel. The interior chamber 14 has an arcuate or conical transition portion 27 with a conical interior surface 27 axially disposed upstream from a socket portion 31. The socket portion 31 receives the shank 29 of the swirler core 28 with mating axisymmetric interior and exterior surfaces respectively.

The swirler core 28 is disposed within the interior chamber 14. The swirler core 28 has a conical downstream end 25 with a conical exterior surface matching the conical transition portion 27. The matching conical shapes are simple for machining or manufacturing processes however using additive manufacturing processes various arcuate shapes can be formed from axisymmetric surfaces of revolution (ex: S-shaped, parabola shaped, nested stepped surfaces etc). The upstream shank 29 of the swirler core 28 has an exterior surface matching the axisymmetric interior surface of the socket portion 31 of the interior chamber 14 of the swirler housing 15.

The downstream end 25 includes a plurality of fuel channels 26 to convey fuel from the annular tip gallery 21 to the outlet orifice 17. The shank 29 has a plurality of axially extending grooves 30 disposed axisymmetrically about the exterior surface of the shank 30. As seen in FIG. 6, the grooves 30 are spaced about the circumference of the shank 29 to provide an axisymmetric cross-section and balanced stress distribution under axial load. In the example illustrated the exterior surface of the shank 29 portion has a uniform axial cross-section and the exterior surface is prismatic. However the depth of the grooves 30 could vary axially, the width of grooves 30 could vary or the grooves 30 could be interrupted with intermediate galleries (not shown) machined into the shank 29. The number of grooves 30 could also vary from the three grooves 30 illustrated. As mentioned above, use of additive manufacturing processes frees the designer from the limits of traditional machining or casting processes and the plurality of axially extending grooves 30 can be axial grooves, helical grooves or intermittent grooves with intermediate galleries formed in the shank 29.

Since the swirler housing 15 does not change, use of the swirler core 28 shown in FIGS. 5-6 continues to include a shank 29 with inlet and tip waist zones 18, 19 (see FIG. 5) of reduced cross-section that define the fuel accumulation annular inlet gallery 20 and annular tip gallery 21. Also the plurality of axially extending grooves 30 serve to convey fuel from the fuel accumulation annular inlet gallery 20 to annular tip gallery 21, in a manner similar to the fuel passage 24 created by the flat portion 22 of a conventional swirler core 13 (FIGS. 2-4).

Figures 7A, 7B:
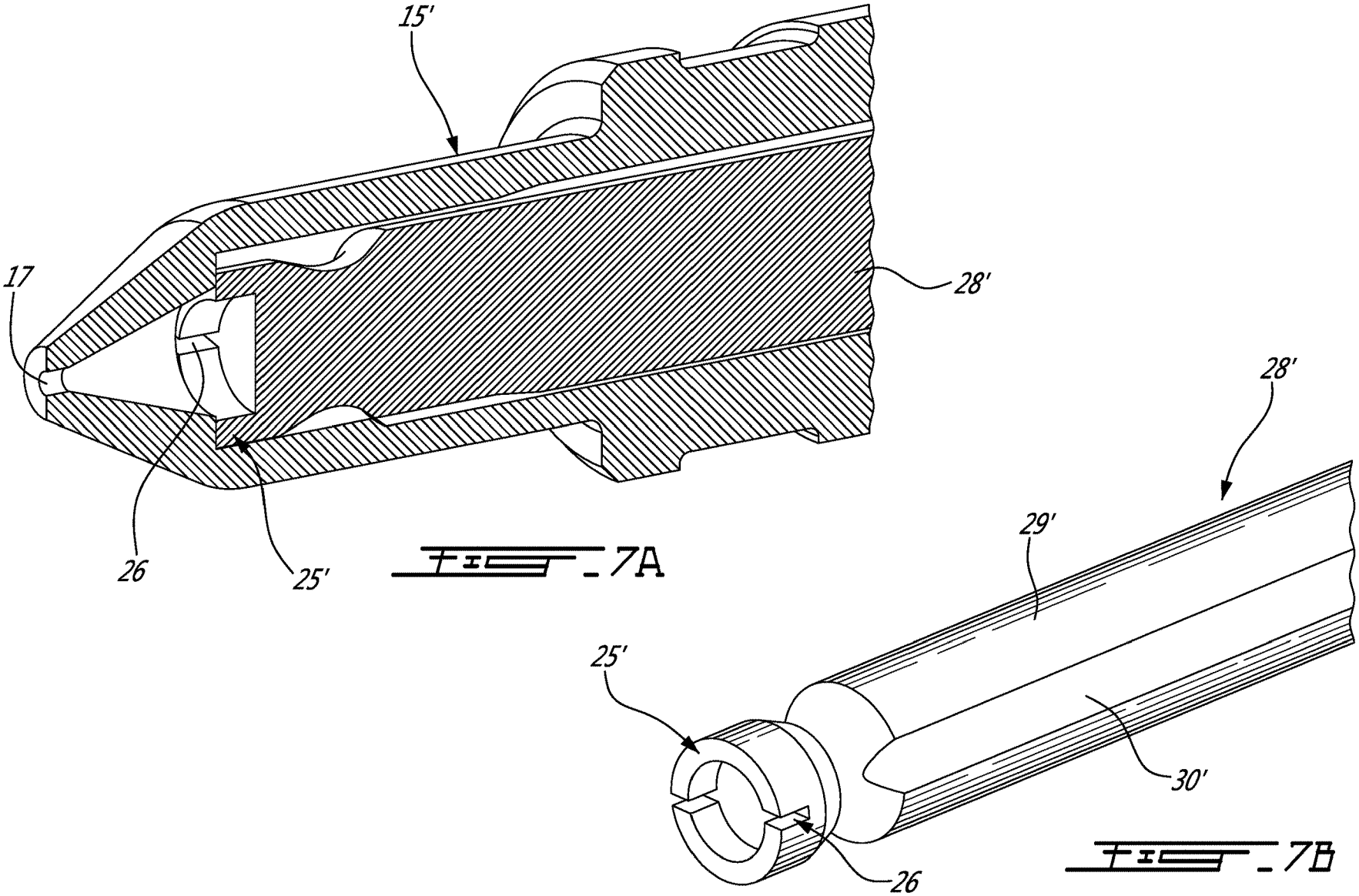
FIGS. 7*a* and 7*b* illustrates an alternative wherein the downstream end of the swirler core is flat for abutment against a corresponding flat surface in the swirler housing.

As shown in FIGS. 7*a* and 7*b*, it is understood that the downstream end 25' of the swirler core 28' can adopt various configurations. For instance, instead of being conical, it could be generally cylindrical with a flat terminal end for abutment against a corresponding flat arresting surface in the swirler housing 15'.

The above description is meant to be exemplary only, and one skilled in the relevant arts will recognize that changes may be made to the embodiments described without departing from the scope of the invention disclosed. The present disclosure may be embodied in other specific forms without departing from the subject matter of the claims. The present disclosure is intended to cover and embrace all suitable changes in technology. Modifications which fall within the scope of the present invention will be apparent to those skilled in the art, in light of a review of this disclosure, and such modifications are intended to fall within the appended claims. Also, the scope of the claims should not be limited by the preferred embodiments set forth in the examples, but should be given the broadest interpretation consistent with the description as a whole.

What is claimed is:

1. A fuel swirler for a gas turbine engine fuel nozzle, the fuel swirler comprising:

a primary cone swirler housing defining an interior chamber having a central axis extending coaxially through a fuel outlet at a tip of the primary cone swirler housing, the interior chamber having a transition portion with a conical interior surface axially disposed downstream from a socket portion relative to a fuel flow direction through the fuel swirler, the conical interior surface converging in a downstream direction to the fuel outlet, the socket portion having an axisymmetric interior surface extending around the central axis; and a swirler core press fit with axial force into the interior chamber, the swirler core being solid and having a downstream end mating with the transition portion and an upstream shank portion having an axisymmetric exterior surface for mating with the axisymmetric interior surface of the socket portion; the upstream shank portion having a plurality of generally axially extending grooves defined in the axisymmetric exterior surface thereof, the plurality of generally axially extending grooves being circumferentially distributed around an axis of the upstream shank portion; wherein the upstream shank portion includes a waist zone of reduced cross-section defining a fuel accumulation gallery and wherein the plurality of axially extending grooves communicate with the fuel accumulation gallery.

2. The fuel swirler according to claim 1 wherein the plurality of generally axially extending grooves are uniformly circumferentially distributed in the axisymmetric exterior surface of the upstream shank portion.

3. The fuel swirler according to claim 2 wherein the axisymmetric exterior surface is cylindrical.

4. The fuel swirler according to claim 1 wherein the plurality of generally axially extending grooves comprise at least three grooves having identical cross-sectional areas.

5. The fuel swirler according to claim 1 wherein the plurality of generally axially extending grooves comprise a first groove having a first cross-sectional area and a second groove having a second cross-sectional area that is unequal to the first cross-sectional area.

6. The fuel swirler according to claim 1 wherein the plurality of generally axially extending grooves comprise one of: axial grooves; and helical grooves and intermittent grooves.

7. A gas turbine engine fuel nozzle comprising:

a primary cone swirler housing having a central axis extending through a fuel outlet of an interior chamber, the interior chamber having an inlet in communication with a source of pressurized fuel, the interior chamber comprising a socket portion with an axisymmetric interior surface around the central axis; and a swirler core axially press fit into the interior chamber, the swirler core being solid and having a downstream end and a shank portion having an axisymmetric exterior surface received in the socket portion of the swirler housing, the downstream end of the swirler core having a plurality of fuel channels, and the shank portion of the swirler core having a plurality of axially extending grooves defined in the axisymmetric exterior surface, the plurality of axially extending grooves being circumferentially distributed about the axisymmetric exterior surface of the shank portion; wherein the shank portion includes a waist zone of reduced cross-section defining a fuel accumulation gallery and wherein the plurality of axially extending grooves communicate with the fuel accumulation gallery.

8. The gas turbine engine fuel nozzle according to claim 7 wherein the plurality of generally axially extending grooves are uniformly circumferentially distributed in the axisymmetric exterior surface of the shank portion.

9. The gas turbine engine fuel nozzle according to claim 7 wherein the axisymmetric exterior surface is cylindrical.

10. The gas turbine engine fuel nozzle according to claim 7 wherein the plurality of axially extending grooves have identical cross-sectional areas.

11. The gas turbine engine fuel nozzle according to claim 7 wherein the plurality of axially extending grooves comprise a first groove having a first cross-sectional area and a second groove having a second cross-sectional area that is unequal to the first cross-sectional area.

12. The gas turbine engine fuel nozzle according to claim 7 wherein the plurality of axially extending grooves comprise one of: axial grooves; and helical grooves and intermittent grooves.

* * * * *